US008671928B2

(12) United States Patent
Hague et al.

(10) Patent No.: US 8,671,928 B2
(45) Date of Patent: Mar. 18, 2014

(54) ELECTRO-PNEUMATIC PROJECTILE LAUNCHING SYSTEM

(75) Inventors: Stephen James Hague, Newark, DE (US); Jordan Anderson, New Castle, DE (US); Benjamin Noji, Claymont, DE (US)

(73) Assignee: Polarstar Engineering & Machine, Newark, DE (US)

( * ) Notice: Subject to any disclaimer, the term of this patent is extended or adjusted under 35 U.S.C. 154(b) by 0 days.

(21) Appl. No.: 13/359,666

(22) Filed: Jan. 27, 2012

(65) Prior Publication Data

US 2012/0192847 A1 Aug. 2, 2012

Related U.S. Application Data

(60) Provisional application No. 61/436,857, filed on Jan. 27, 2011.

(51) Int. Cl.
*F41B 11/32* (2006.01)

(52) U.S. Cl.
USPC ..... 124/77; 124/73

(58) Field of Classification Search
USPC ..... 124/77, 73
See application file for complete search history.

(56) References Cited

U.S. PATENT DOCUMENTS

| | | | | |
|---|---|---|---|---|
| 4,770,153 | A * | 9/1988 | Edelman | 124/72 |
| 6,810,871 | B2 * | 11/2004 | Jones | 124/77 |
| 7,121,273 | B2 * | 10/2006 | Styles | 124/77 |
| 7,509,953 | B2 * | 3/2009 | Wood | 124/73 |
| 7,527,049 | B2 * | 5/2009 | Sheng | 124/73 |
| 7,533,664 | B2 * | 5/2009 | Carnall | 124/77 |
| 7,603,997 | B2 | 10/2009 | Hensel et al. | |
| 7,730,881 | B1 | 6/2010 | Pedicini et al. | |
| 7,861,703 | B2 * | 1/2011 | Liao | 124/77 |
| 7,878,106 | B2 | 2/2011 | Hu | |
| 7,921,839 | B2 * | 4/2011 | Wood | 124/73 |
| 7,931,018 | B1 * | 4/2011 | Lai | 124/77 |
| 8,033,276 | B1 * | 10/2011 | Gabrel | 124/73 |
| 8,104,463 | B2 * | 1/2012 | Wood | 124/73 |
| 8,336,532 | B2 * | 12/2012 | Masse | 124/75 |
| 2002/0096164 | A1 * | 7/2002 | Perrone | 124/77 |
| 2004/0200115 | A1 * | 10/2004 | Monks et al. | 42/84 |
| 2005/0005924 | A1 * | 1/2005 | Sheng | 124/74 |
| 2005/0155591 | A1 * | 7/2005 | Forster | 124/74 |
| 2005/0188977 | A1 * | 9/2005 | Wygant | 124/73 |
| 2005/0217655 | A1 * | 10/2005 | Jones | 124/73 |
| 2006/0005823 | A1 * | 1/2006 | Quinn et al. | 124/73 |
| 2006/0231084 | A1 * | 10/2006 | Styles et al. | 124/74 |

(Continued)

*Primary Examiner* — Bret Hayes
*Assistant Examiner* — Derrick Morgan
(74) *Attorney, Agent, or Firm* — Fox Rothschild LLP; Glenn M. Massina; Adam Forman

(57) ABSTRACT

A pneumatic assembly for a projectile launching system includes a body defining a continuous bore. A nozzle is positioned within the bore adjacent a forward end and is moveable between a rearward position wherein the nozzle facilitates passage of a projectile through a projectile port and a forward position wherein the nozzle prevents passage of a projectile through the projectile port. The nozzle is biased to the forward position and configured for fluid actuation to the rearward position by activation of a first fluid control valve. A valve seat defines an accumulation chamber rearward of the nozzle. A firing valve member is moveable between a forward position wherein the firing valve member fluidly seals a passage through the valve seat and a rearward position wherein the passage is fluidly opened such that fluid in the accumulation chamber is free to flow through the passage and out of the nozzle.

20 Claims, 10 Drawing Sheets

(56) References Cited

U.S. PATENT DOCUMENTS

| | | | | |
|---|---|---|---|---|
| 2007/0151549 | A1* | 7/2007 | Wood | 124/73 |
| 2007/0209650 | A1* | 9/2007 | Jones | 124/73 |
| 2007/0215133 | A1* | 9/2007 | Jones | 124/73 |
| 2007/0235016 | A1* | 10/2007 | Moritz | 124/72 |
| 2008/0099005 | A1* | 5/2008 | Kaakkola et al. | 124/74 |
| 2009/0178660 | A1* | 7/2009 | Huang | 124/73 |
| 2009/0199833 | A1* | 8/2009 | Li | 124/77 |
| 2010/0108049 | A1 | 5/2010 | Dobbins | |
| 2010/0199961 | A1* | 8/2010 | Liao | 124/73 |
| 2010/0199963 | A1* | 8/2010 | Liao | 124/75 |
| 2011/0232618 | A1 | 9/2011 | Gabrel | |
| 2011/0315134 | A1 | 12/2011 | Tsai | |
| 2013/0104868 | A1* | 5/2013 | Sikes | 124/77 |

* cited by examiner

ELECTRO-PNEUMATIC PROJECTILE LAUNCHING SYSTEM

This application claims the benefit of U.S. Provisional Application No. 61/436,857 filed on Jan. 27, 2011, the contents of which are incorporated herein.

FIELD OF THE INVENTION

The present invention relates to an electronically controlled, pneumatically operated projectile launching system. A preferred embodiment of the invention is designed for use in airsoft guns.

BACKGROUND OF THE INVENTION

Current airsoft projectile launching systems (as well as non-airsoft systems) include pneumatic and spring power sources. Each suffer from deficiencies affecting accuracy, usability and/or durability.

For example, current spring-powered launching systems use a compressed spring to drive a piston longitudinally within a cylinder, compressing air in front of the piston. As the air is compressed, it is directed behind the projectile to launch the projectile from a barrel. The spring may be compressed by human power or by an electric motor. Due to the stresses applied by the compressed spring these types of systems are prone to mechanical failure. In addition to the deficiencies in durability, accuracy in spring powered systems is negatively affected by the impact of the piston at the end of its travel. Pneumatic launching systems that offer independent control and timing of the nozzle and valve (stacked tube configuration) are bulky and thus will not fit into the space available for an airsoft gun.

There is therefore a need for improved projectile launching systems.

SUMMARY

In at least one embodiment, the present invention provides a pneumatic assembly for a projectile launching system including a body defining a continuous bore from a substantially open forward end of the body to a substantially closed rearward end of the body. A nozzle is positioned within the bore adjacent the forward end of the body and is moveable between a rearward position wherein the nozzle facilitates passage of a projectile through a projectile port and a forward position wherein the nozzle blocks the projectile port to prevent passage of a projectile therethrough. The nozzle is biased to the forward position and configured for fluid actuation to the rearward position by activation of a first fluid control valve. A valve seat is positioned within the bore rearward of the nozzle and sealingly engages an internal surface of the bore such that an accumulation chamber is defined between the valve seat and the rearward end of the body. A firing valve member is positioned within the bore and is moveable between a forward position wherein the firing valve member fluidly seals a passage through the valve seat and a rearward position wherein the passage is fluidly opened such that fluid in the accumulation chamber is free to flow through the passage and out of the nozzle. The firing valve member is biased to the forward position and configured for fluid actuation to the rearward position by activation of a second fluid control valve which is independent of the first fluid control valve.

In at least one embodiment, the invention further includes a sealed nozzle fluid chamber defined about the nozzle and axially aligned with a nozzle fluid port in communication with the first fluid control valve, wherein actuation of the first fluid control valve supplies fluid through the nozzle fluid port into the nozzle fluid chamber whereby the nozzle is moved to the rearward position.

In at least one embodiment, the invention further includes a sealed firing valve fluid chamber defined about the firing valve member and axially aligned with a firing valve fluid port in communication with the second fluid control valve, wherein actuation of the second fluid control valve supplies fluid through the firing valve fluid port into the firing valve fluid chamber whereby the firing valve member is moved to the rearward position.

In at least one embodiment, the first and second fluid control valves are solenoid valves.

In at least one aspect, the invention provides a projectile launching assembly including a pneumatic assembly, a trigger mechanism and an electronic unit, wherein actuation of the trigger mechanism causes the electronic unit to activate a timing circuit that selectively activates a first control valve for a first given amount of time and selectively activates a second control valve for a second given amount of time.

DETAILED DESCRIPTION

Although the invention is illustrated and described herein with reference to specific embodiments, the invention is not intended to be limited to the details shown. Rather, various modifications may be made in the details within the scope and range of equivalents of the claims and without departing from the invention. The invention is described below with reference to a compressed gas, however, it is understood that the compressed gas may be any fluid as known to those skilled in the art or which may become discovered by those skilled in the art.

Figure 1:
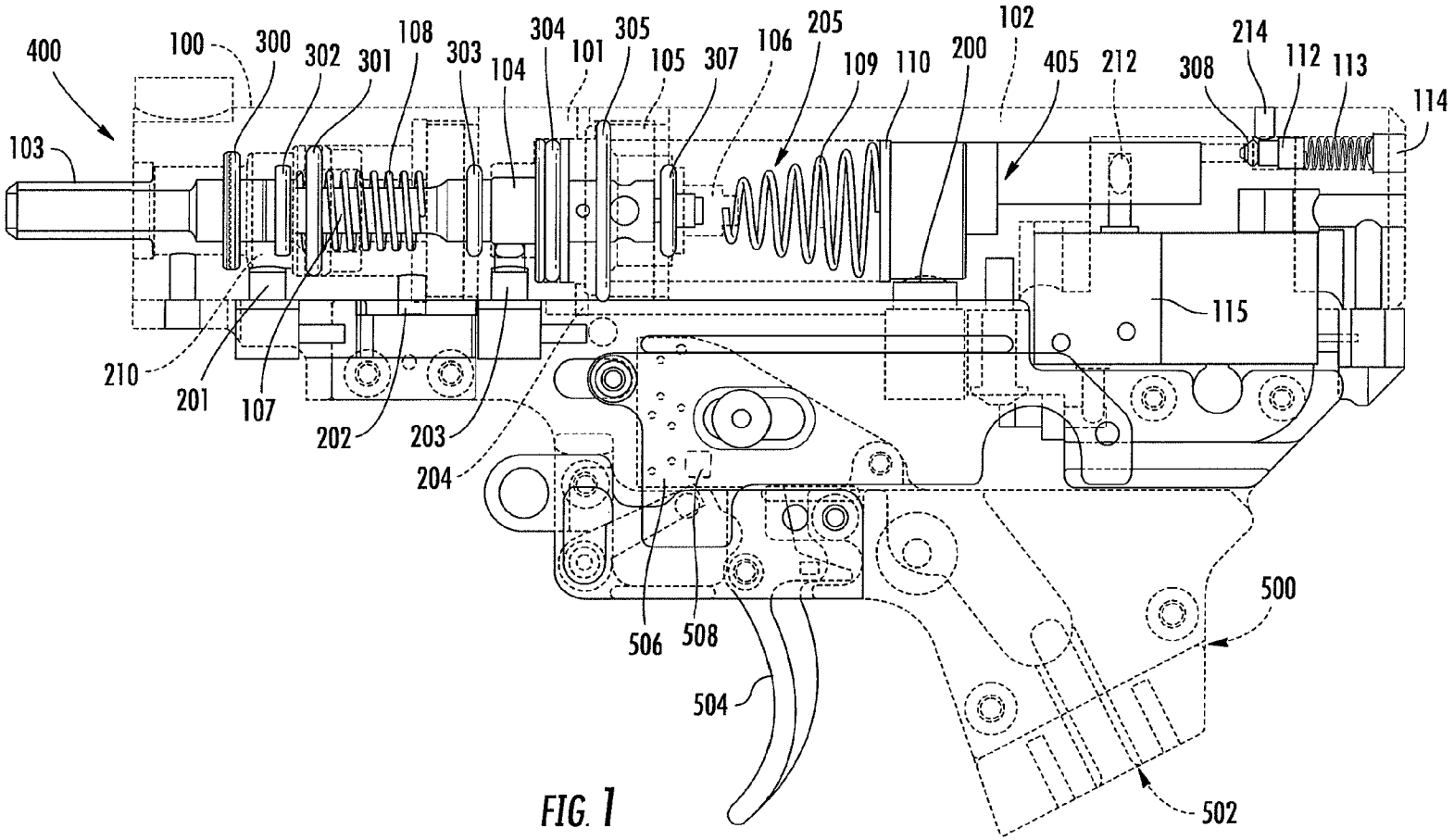
FIG. 1 is a left side view, with various components shown in phantom, of a projectile launching assembly incorporating a pneumatic assembly in accordance with a first embodiment of the invention.
Figure 2:
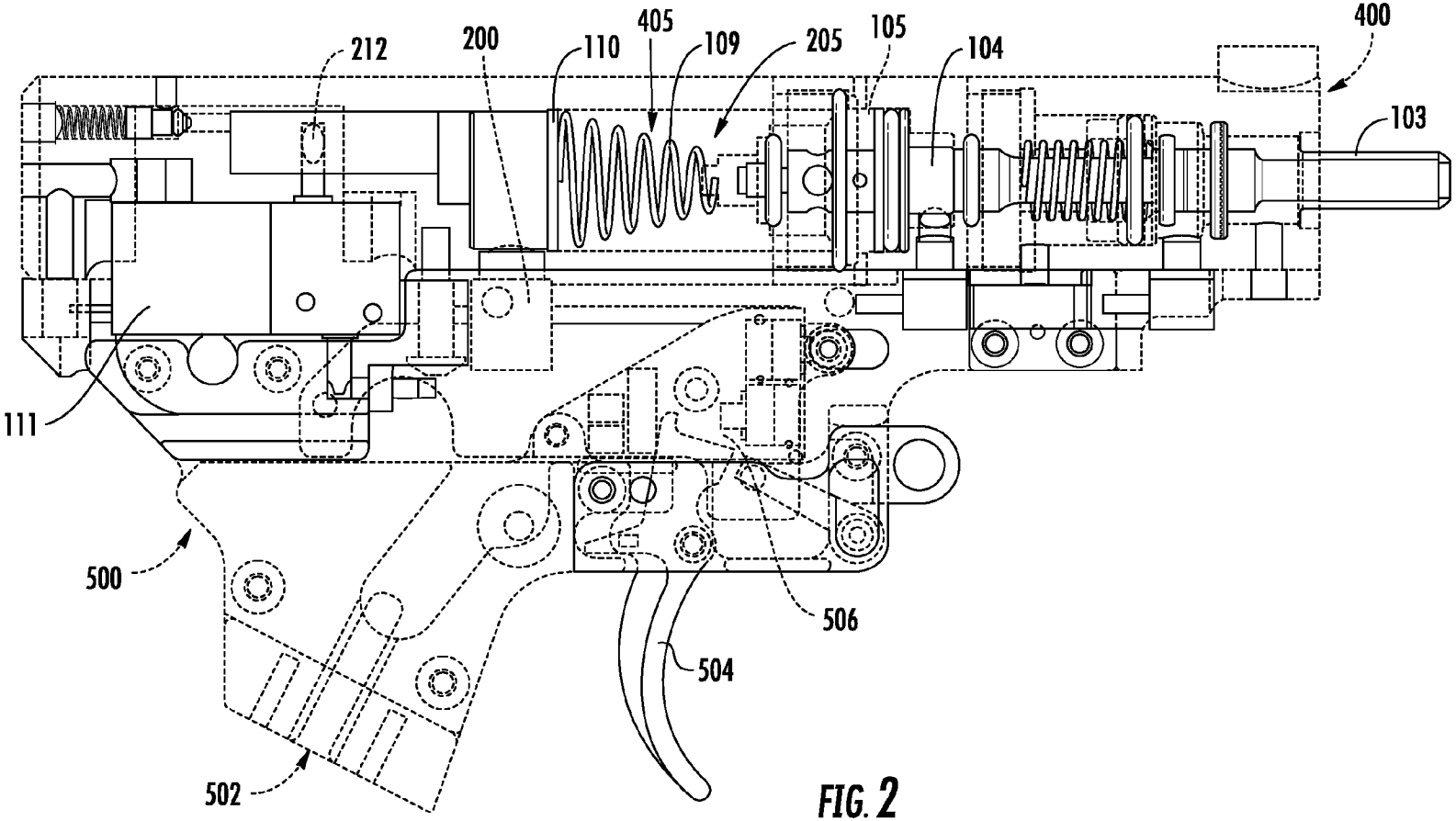
FIG. 2 is a right side view, with various components shown in phantom, of the projectile launching assembly of FIG. 1.
Figure 3:
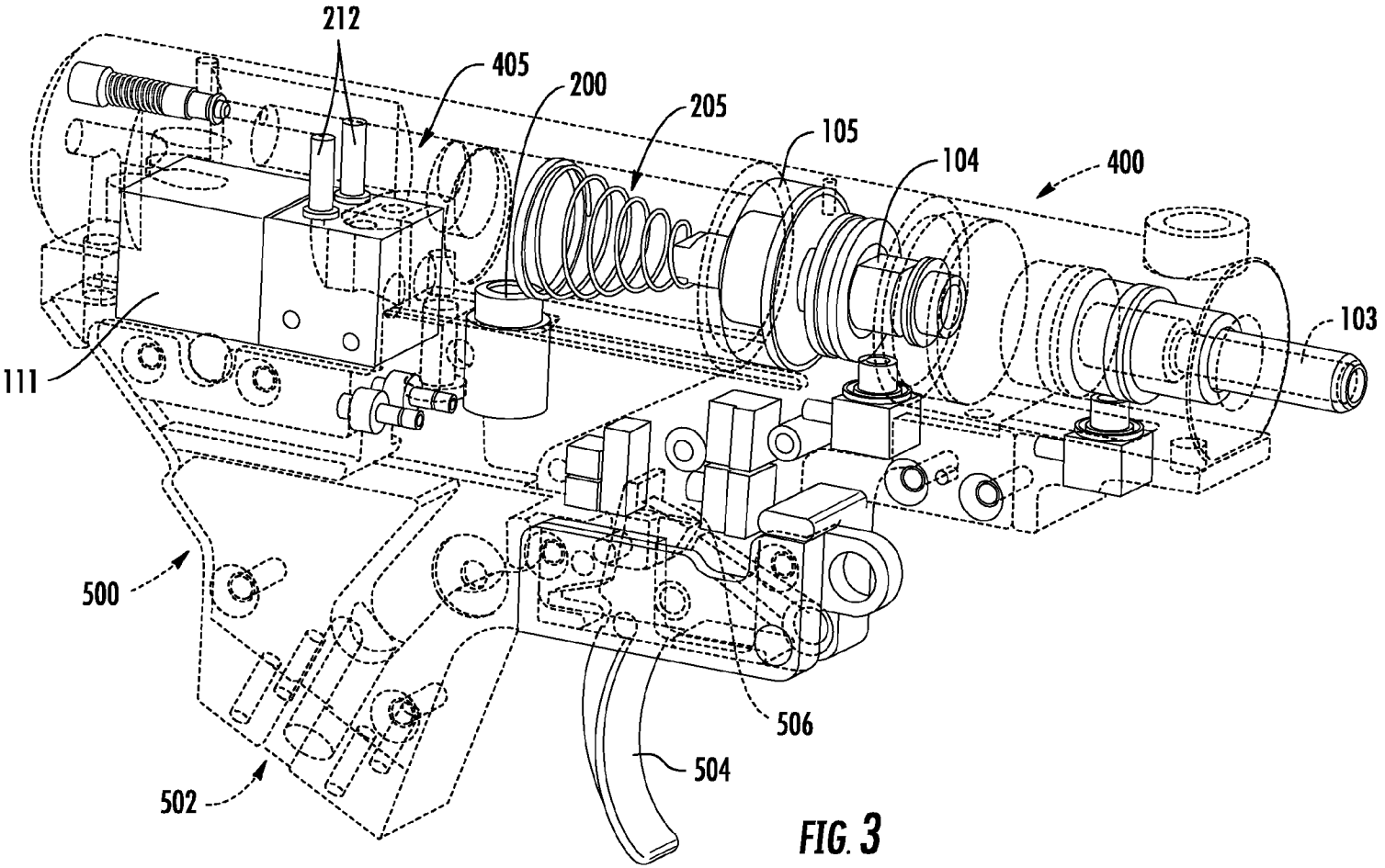
FIG. 3 is a right, front isometric view, with various components shown in phantom, of the projectile launching assembly of FIG. 1.
Figure 4:
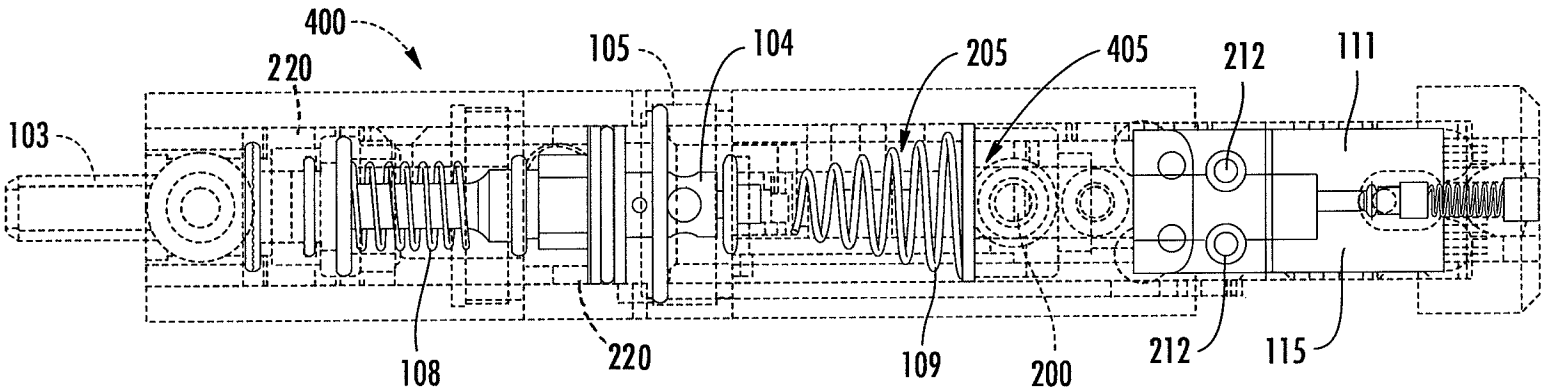
FIG. 4 is a top view, with various components shown in phantom, of the projectile launching assembly of FIG. 1.
Figure 5:
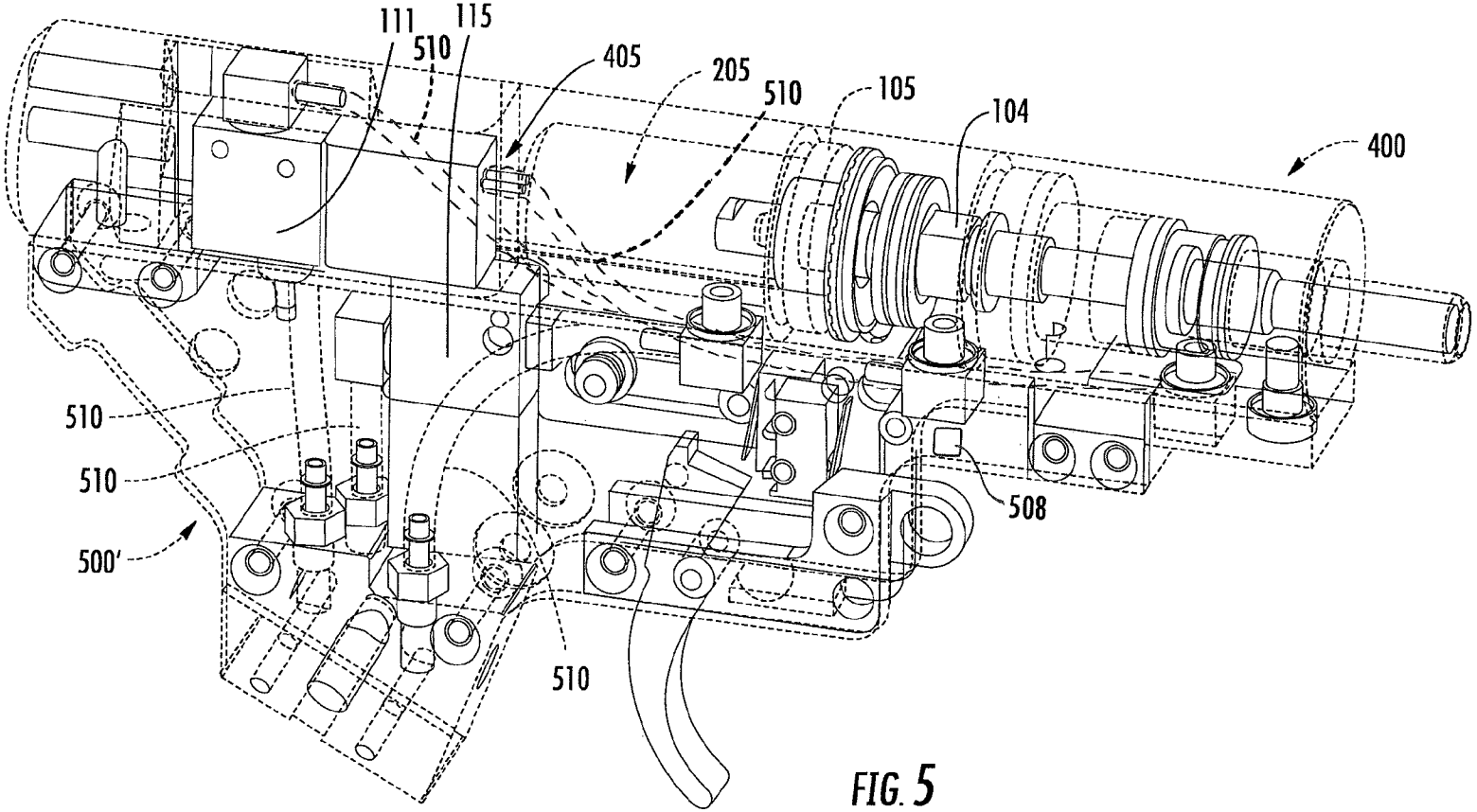
FIG. 5 is a right, front isometric view, with various components shown in phantom, of an alternative embodiment of the projectile launching assembly.

Referring to FIGS. 1-4 and 6A-10, a pneumatic assembly 400 in accordance with a first embodiment of the invention will be described. As shown in FIGS. 1-4, the pneumatic assembly 400 is illustrated attached to a launcher body 500 to define at least a portion of a projectile launching system, for example, an airsoft gun. In the present embodiment, the launcher body 500 includes a receiver opening 502 configured for passage of gas input hose, wiring and the like as is known in the art. In the present exemplary embodiment, the launcher body 500 defines internal integral passages 220 which supply the compressed gas to an inlet port 200 of the pneumatic assembly 400 and to other ports within the pneumatic assembly 400 including the nozzle fluid port and the firing valve fluid port which are described below. As shown in the alternative embodiment illustrated in FIG. 5, alternatively, various tubes 510 or the like may extend through the body 500' to provide the passages for the compressed gas. The embodiment of FIG. 5 further illustrates that one or both of the control valves 111, 115 may be housed within the body 500' as opposed to within the pneumatic assembly 400 as illustrated in the embodiment of FIGS. 1-4 and 6A-10. As further shown in FIG. 1, the launching system further comprises a trigger 504 and a switch board 506 which serves as a mounting point for switches and provides a location to mount plugs for the wiring harness and solenoid valves. The wiring harness leads to an electronic control unit 508 which may be mounted externally of the body 500 or internally, for example, mounted on the switch board 506. Actuation of the trigger 504 causes the electronic control unit to actuate the switches which in turn supply control signals to the control valves 111, 115 as described in more detail below. The launching system may include further elements, for example, a trigger safety and a selection plate, as is known in the art.

Additionally, as show in FIGS. 6A-10, the pneumatic assembly 400 is preferably also utilized with a breech 125, a hop-up chamber or the like as known in the art. The breech 125 is positioned adjacent an open end 406 of the pneumatic assembly body 402 such that a bore therethrough is coaxial with a nozzle 103 of the pneumatic assembly 400. The breech 125 includes a projectile port 222 which supplies projectiles 401, for example, from a hopper, magazine or the like as is known in the art.

Figure 7:
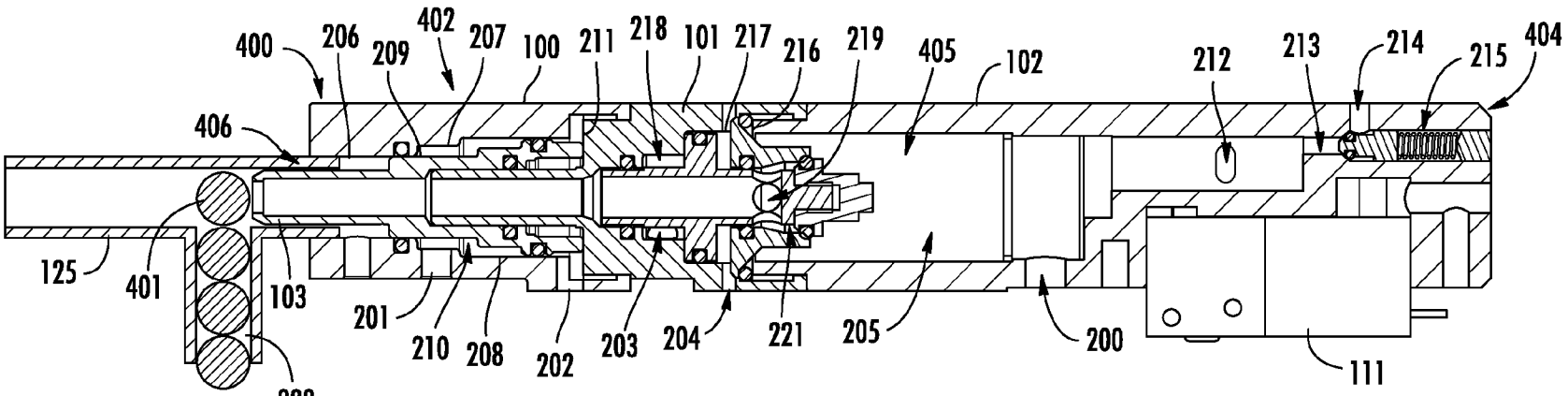
FIG. 7 is a left side sectional view similar to FIG. 6A showing the pneumatic assembly in a loading position.

With reference to FIG. 7, the body 402 of the pneumatic assembly 400 includes a continuous bore 405 extending from a substantially closed end 404 to the substantially open end 406. In the illustrated embodiment, the body 402 is formed from a front cylinder 100, center cylinder 101 and rear cylinder 102 which are joined longitudinally to define the body 402. While the illustrated embodiment includes a multipart housing, the invention is not limited to such and the body 402 may include a single component or any number of components.

Figure 6A:
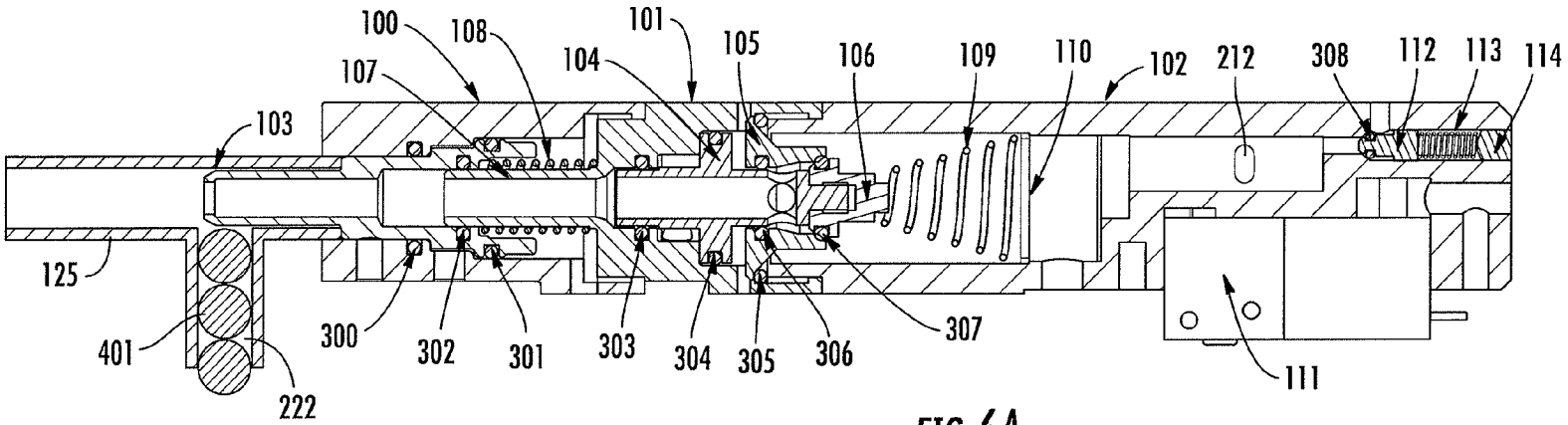
FIG. 6A is a left side sectional view of the pneumatic assembly of FIG. 1 in a ready position and FIG. 6B is a rear end view thereof.
Figure 6B:
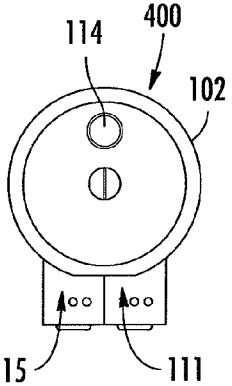

Referring to FIGS. 6A and 7, in the exemplary embodiment, the front cylinder 100 includes a series of concentric bores 206, 207, 208 of varying sizes in which a tubular nozzle 103 slides. The bores 206, 207, 208 form a part of the continuous bore 405. The forward most bore 206 of the front cylinder 100 receives an o-ring 300 in an internal groove which provides a seal on an outer diameter of the nozzle 103. The shoulder 209 formed by this bore also serves as a stop to limit the forward travel of the nozzle 103. An external groove on the rear most diameter of the nozzle 103 accepts an o-ring 301 which seals on the inside diameter of the front cylinder 100. This forms a nozzle fluid chamber 210 isolated from atmosphere that can receive and release a volume of compressed gas from the nozzle input port 201. The nozzle 103 slides within the bores of the front cylinder 100 as well as sliding on the nozzle stem 107, which protrudes from the front surface of the center cylinder 101. A nozzle spring 108 is contained between the rear surface of the nozzle 103 and the front surface 211 of the center cylinder 101. The front surface 211 of the center cylinder 101 also serves as a stop to limit the rearward travel of the nozzle 103. As shown in FIGS. 6A and 7, the nozzle spring 108 biases the nozzle 103 to a forward position. In this forward position, a forward portion of the nozzle 103 is aligned with the projectile port 222 of the breech 125. In this position, the nozzle 103 prevents passage of the projectiles 401, which are preferably biased from a supply chamber, for example, a magazine (not shown), into the bore of the breech 125. As described in more detail below, during loading, the nozzle 103 is moved rearward such that the nozzle is no longer aligned with the port 222 and projectile 401 may pass into the bore of the breech 125.

The rear cylinder 102 contains a portion of the internal continuous bore 405 which defines, in part, an accumulation chamber 205 for storing a volume of compressed gas. A firing valve seat 105 and an o-ring 305 are captured between the front surface 216 of the rear cylinder 102 and an internal shoulder 217 formed by a series of concentric bores within the center cylinder 101. The o-ring 305 forms a seal between the front surface 216 of the rear cylinder 102, the firing valve seat 105, and the inside surface of the center cylinder 101. This seal prevents compressed gas from flowing out of the accumulation chamber 205 through the joint between the center cylinder 101 and rear cylinder 102. A gas supply port 200 extends through the cylinder 102 such that compressed gas, from a gas storage, for example, within an attached magazine, is supplied to the accumulation chamber 205.

The firing valve seat 105 includes a passage 221 therethrough. A firing valve body 104 is positioned through the passage 221 with a firing valve base 106 extending rearward into the accumulation chamber 205. An external groove on the valve base 106 accepts an o-ring 307 which is configured to seal against the valve seat 105. The firing valve body 104 is biased to the sealed position by a firing valve return spring 109. The firing valve return spring 109 is contained between a rear surface of the firing valve base 106 and the front surface of the firing valve return spring seat 110. The firing valve return spring seat 110 is contained between the firing valve return spring 109 and a shoulder formed by a series of concentric bores in the rear cylinder 102.

An internal groove in the center cylinder 101 accepts an o-ring 303 which seals on an outer diameter of the firing valve body 104 while an external groove on the firing valve body 104 accepts an o-ring 304, sealing on the inside diameter of the center cylinder 101. This forms a firing valve fluid chamber 218 isolated from atmosphere that can receive and release a volume of compressed gas from the firing valve input port 203. An internal groove in the firing valve seat 105 accepts an o-ring 306 which seals on an outer diameter of the firing valve body 104 and prevents compressed gas from flowing out of the firing valve exhaust port 204 when the firing valve is in the open position. As described below, the nozzle 103, the firing valve body 104 in conjunction with the valve seat 105, and the accumulation chamber 205 provide a simple firing system which is compact and contained within a single bore 405. This provides a reliable, compact firing system. The nozzle 103, firing valve body 104 and the valve seat 105 are preferably coaxial with one another and with the bore 405, however, such is not required.

A pressure relief port 214 is in fluid communication with the accumulation chamber 205 through a longitudinal bore 213. A pressure relief valve plunger 112 and pressure relief valve spring 113 are contained between a pressure relief valve screw 114 and a shoulder formed by bore 213 and the concentric bore 215. An external grove on the outside diameter of the pressure relief valve plunger 112 accepts an o-ring 308 which seals on the shoulder formed by bore 213 and the concentric bore 215 and prevents compressed gas from flowing to the pressure relief port 214 unless excess pressure is applied to the pneumatic assembly 400.

In the embodiment of FIGS. 1-4 and 6A-10, the input ports of control valves 111, 115 are in fluid communication with the accumulation chamber 205 through a series of bores 212 in the rear cylinder 102. This series of bores 212 serve as an integral manifold to distribute compressed gas within the pneumatic assembly 400. While the present embodiment makes use of series of bores 212 which serve as an integral manifold to distribute compressed gas within the pneumatic assembly 400, it is understood that other embodiments are possible and that a separate manifold may be used to direct compressed gas to the supply port 200 and control valves 111, 115 separately as illustrated, for example, in FIG. 5.

In various embodiments of the present invention the muzzle energy produced is directly related to the pressure of the compressed gas supplied to the accumulation chamber 205. As the gas pressure is increased the muzzle energy produced also increases. In the sport of airsoft it is desirable to maintain a muzzle energy between 1 J and 3 J for safety purposes. In the present embodiment this energy range may be achieved with gas pressures between 70 PSI and 120 PSI. As this is also within the operating pressure range of the control valves chosen, no additional pressure regulation is necessary. It is understood that other embodiments are possible, however, and that the addition of a gas pressure regulator to supply the control valves 111,115 with a gas pressure different from the pressure supplied to the accumulation chamber 205 is within the scope of this invention.

The control valves 111, 115 are utilized to control flow of compressed gas to the nozzle port 201 and the firing valve port 203, as described in more detail below. In various embodiments, the control valves 111, 115 are solenoid valves 111, 115 which are normally closed 3-way valves, such as the MAC 33 Series manufactured by MAC Valves, of Wixom, Mich. The solenoids can employ, for example, 5V/4 W coils. Although direct acting valves are used, suitable air-piloted solenoid valves may also be used.

The electronic control unit is utilized to control timing and operation of the control valves 111, 115. Any suitable electronics may be employed, from relatively simple dedicated timing circuits to more general purpose microcontrollers or the like. For example, an electronic control unit as disclosed in U.S. Pat. No. 7,603,997 may be employed. However, one of reasonable skill in the art will appreciate than any suitable electronics may be employed to control timing and operations of the control valves 111, 115, as known in the art. In addition to controlling the timing operations of the control valves 111, 115, the electronic control unit may also be configured to receive input from and/or control other elements of the launching system.

Figure 8:
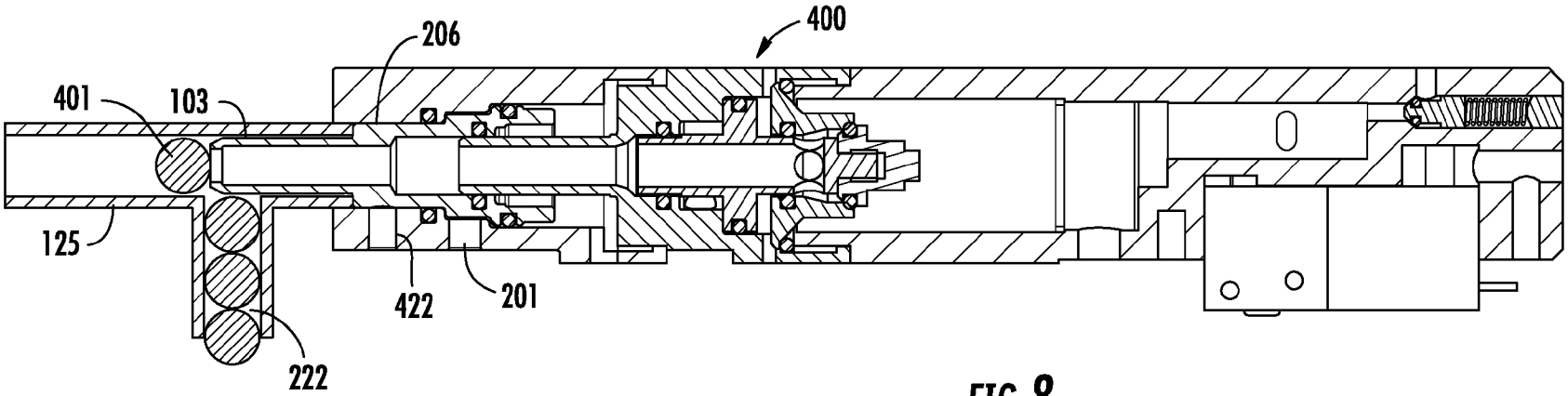
FIG. 8 is a left side sectional view similar to FIG. 6A showing the pneumatic assembly in a ready to fire position.
Figure 9:
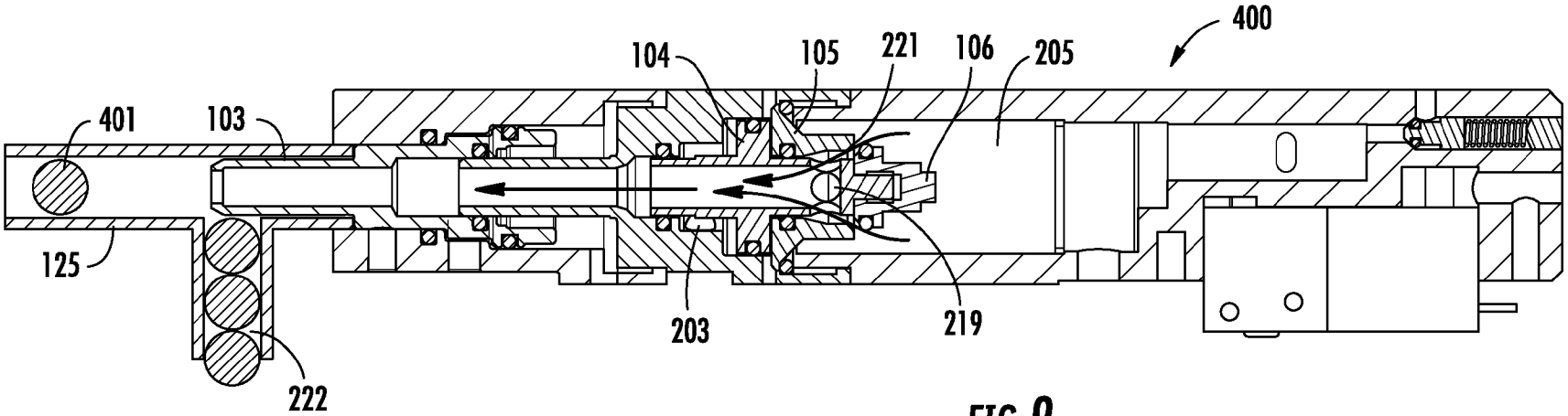
FIG. 9 is a left side sectional view similar to FIG. 6A showing the pneumatic assembly in the firing position.
Figure 10:
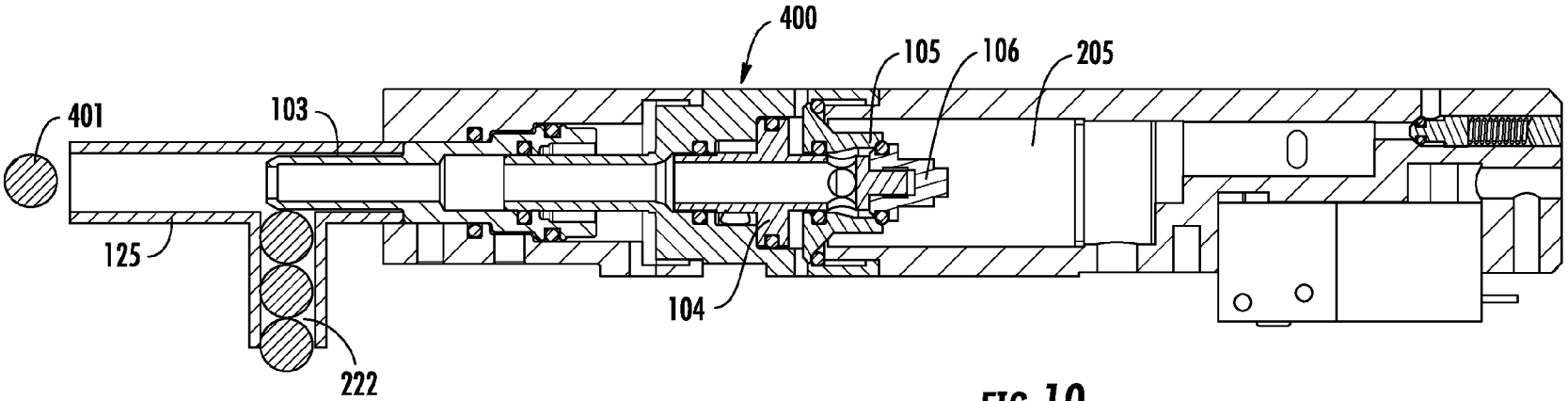
FIG. 10 is a left side sectional view similar to FIG. 6A showing the pneumatic assembly after firing.

In the loading operation, power is applied to the first control valve 111 by the electronic control unit, directing the flow of gas to the nozzle input port 201 which moves the nozzle 103 rearward. As the nozzle 103 moves rearward, the nozzle spring 108 is compressed and gas in the area behind the nozzle 103 is vented to atmosphere through the nozzle exhaust port 202. When the nozzle 103 moves to the rearward position, the projectile port 222 is cleared and a projectile 401 is biased into the bore and into the nozzle 103 as shown in FIG. 7. A timing circuit within the electronic control unit preferably allows a period of time to elapse before power is removed from the first control valve 111, allowing pressure in front of the nozzle 103 to vent to atmosphere through the first control valve 111. This time period is typically between 5 ms and 15 ms. Alternatively, a QEV or "Quick Exhaust Valve" may be used to vent air directly at the input port 201 to increase the return speed of the nozzle 103. The compressed nozzle spring 108 returns the nozzle 103 to the forward position, as shown in FIG. 8. A timing circuit within the electronic control unit preferably allows a period of time to elapse while the nozzle 103 is returned to the forward position. This time period is typically between 9 ms and 20 ms.

In the firing operation, power is applied to the second control valve 115, directing the flow of gas to the firing valve input port 203 which moves the firing valve body 104 and firing valve base 106 rearward while gas behind the firing valve body 104 is vented to atmosphere through the firing valve exhaust port 204. As the firing valve base 106 moves rearward the gas seal between the valve base 106 and valve seat 105 is opened, releasing compressed gas from the accumulation chamber 205 through a series of radial ports 219 in the firing valve body 104 and then through the nozzle 103, launching the projectile 401. A timing circuit within the electronic control unit allows a period of time to elapse before power is removed from the second solenoid 115, allowing pressure in front of the valve body to vent to atmosphere through the second control valve 115. This delay is typically between 3 ms and 5 ms. The compressed firing valve return spring 109 returns the firing valve body 104 and firing valve base 106 to the forward position, closing the gas seal between the firing valve base 106 and firing valve seat 105. In automatic fire modes a timing circuit within the electronic control unit allows a period of time to elapse before beginning the loading of the next projectile. This delay is typically between 5 ms and 25 ms.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

The invention claimed is:

1. A pneumatic assembly for a projectile launching system comprising:

a body defining a continuous bore from a substantially open forward end of the body to a substantially closed rearward end of the body;

a nozzle positioned within the bore adjacent the forward end of the body, the nozzle moveable between a rearward position wherein the nozzle facilitates passage of a projectile through a projectile port and a forward position wherein the nozzle blocks the projectile port to prevent passage of a projectile therethrough, the nozzle biased to the forward position and configured for fluid actuation to the rearward position by activation of a first fluid control valve; a valve seat positioned within the bore rearward of the nozzle, the valve seat sealingly engaging an internal surface of the bore such that an accumulation chamber is defined between the valve seat and the rearward end of the body, the accumulation chamber including an inlet port;

a firing valve member positioned within the bore and moveable between a forward position wherein the firing valve member fluidly seals a passage through the valve seat and a rearward position wherein the passage is fluidly opened such that fluid in the accumulation chamber is free to flow through the passage and out of the nozzle, the firing valve member biased to the forward position and configured for fluid actuation to the rearward position by activation of a second fluid control valve which is independent of the first fluid control valve and which selectively provides fluid to a firing valve input port positioned forward of the accumulation chamber, the firing valve member independent of the inlet port such that the firing valve member does not directly control flow between the inlet port and the accumulation chamber; and wherein flow of fluid in the accumulation chamber through the passage and out of the nozzle is independent of the position of the nozzle.

2. The pneumatic assembly of claim 1 wherein the nozzle is biased to the forward position by a spring.

3. The pneumatic assembly of claim 1 wherein the firing valve body is biased to the forward position by a spring.

4. The pneumatic assembly of claim 1 wherein a sealed nozzle fluid chamber is defined about the nozzle and the sealed nozzle fluid chamber is axially aligned with a nozzle fluid port in communication with the first fluid control valve, wherein actuation of the first fluid control valve supplies fluid through the nozzle fluid port into the nozzle fluid chamber whereby the nozzle is moved to the rearward position.

5. The pneumatic assembly of claim 1 wherein a sealed firing valve fluid chamber is defined about the firing valve member and the sealed firing valve fluid chamber is axially aligned with a firing valve fluid port in communication with the second fluid control valve, wherein actuation of the second fluid control valve supplies fluid through the firing valve fluid port into the firing valve fluid chamber whereby the firing valve member is moved to the rearward position.

6. The pneumatic assembly of claim 1 wherein the first and second fluid control valves are solenoid valves.

7. A projectile launching assembly comprising the pneumatic assembly of claim 6, a trigger mechanism and an electronic unit, wherein actuation of the trigger mechanism causes the electronic unit to activate a timing circuit that selectively activates the first solenoid valve for a first given amount of time and selectively activates the second solenoid valve for a second given amount of time.

8. The projectile launching assembly of claim 7 wherein the timing circuit waits a third given amount of time after conclusion of the first given amount of time before activating the second solenoid valve.

9. The projectile launching assembly of claim 8 wherein the first given amount of time is between 5 ms and 15 ms, the second given amount of time is between 3 ms and 5 ms and the third given amount of time is between 9 ms and 20 ms.

10. The projectile launching assembly of claim 8 wherein during continuous actuation of the trigger mechanism, the timing circuit waits a fourth given amount of time after conclusion of the second given amount of time before activating the first solenoid valve again.

11. The projectile launching assembly of claim 10 wherein the fourth given amount of time is between 5 ms and 25 ms.

12. The projectile launching assembly of claim 7 wherein the trigger is located in a launcher body attached to the body of the pneumatic assembly.

13. The projectile launching assembly of claim 12 wherein the electronic control unit is located externally of the launcher body.

14. The projectile launching assembly of claim 12 wherein the electronic control unit is located within the launcher body.

15. A projectile launching system comprising the pneumatic assembly of claim 1 and a launcher body attached thereto, wherein one or both of the control valves is located within the launcher body.

16. A projectile launching system comprising the pneumatic assembly of claim 1 and a launcher body attached thereto, wherein the body of the pneumatic assembly and the launcher body define integral passages which interconnect the control valves with the accumulation chamber.

17. The projectile launching system of claim 16 wherein the body of the pneumatic assembly and the launcher body define additional integral passages which interconnect the control valves with a nozzle fluid port and a firing valve fluid port.

18. The projectile launching system of claim 16 wherein tubes within the body of the pneumatic assembly and/or the launcher body define passages which interconnect the control valves with a nozzle fluid port and a firing valve fluid port.

19. A projectile launching system comprising the pneumatic assembly of claim 1 and a breech which defines a breech bore and the projectile port which opens into the breech bore, wherein the breech is configured to be positioned adjacent to the body open forward end such that a portion of the nozzle is positioned within the breech bore.

20. The projectile launching system of claim 19 wherein the breech bore is coaxial with the nozzle.

* * * * *